US007338048B1

(12) United States Patent
Hulstine

(10) Patent No.: US 7,338,048 B1
(45) Date of Patent: Mar. 4, 2008

(54) PORTABLE TARGET RACK

(76) Inventor: David W. Hulstine, 1110 Fourth Ave., Steelton, PA (US) 17113

( * ) Notice: Subject to any disclaimer, the term of this patent is extended or adjusted under 35 U.S.C. 154(b) by 0 days.

(21) Appl. No.: 11/352,180

(22) Filed: Feb. 10, 2006

Related U.S. Application Data

(60) Provisional application No. 60/659,726, filed on Mar. 9, 2005.

(51) Int. Cl.
*F41J 1/10* (2006.01)
*A47B 43/00* (2006.01)

(52) U.S. Cl. ..... 273/407; 211/196

(58) Field of Classification Search ..... 273/403–408, 273/390–392; 211/196, 197, 193, 119.01, 211/205
See application file for complete search history.

(56) References Cited

U.S. PATENT DOCUMENTS 350,227 A * 10/1886 Adams ..... 273/406
574,087 A * 12/1896 Frick ..... 273/402
2,372,111 A * 3/1945 Norberg ..... 273/407
2,538,118 A * 1/1951 Miller ..... 273/407
2,975,999 A * 3/1961 Bunch ..... 248/121
3,076,557 A * 2/1963 Husted et al. ..... 211/196
3,540,729 A * 11/1970 Rahberger ..... 273/407
3,601,353 A * 8/1971 Dale ..... 248/470
4,625,974 A * 12/1986 Andrews ..... 273/407
4,913,389 A 4/1990 McCracken ..... 248/156
5,263,721 A * 11/1993 Lowrance ..... 273/390
5,280,919 A 1/1994 Graham ..... 273/381
5,580,062 A * 12/1996 Dehlinger ..... 273/378
D388,128 S 12/1997 Young ..... D21/6
5,967,523 A * 10/1999 Brownlee ..... 273/407
2004/0036223 A1* 2/2004 Wilkus ..... 273/407

* cited by examiner

*Primary Examiner*—Mark S Graham
(74) *Attorney, Agent, or Firm*—Hooker & Habib, P.C.

(57) ABSTRACT

A portable target rack capable of simultaneously holding multiple shooting targets includes a base and arms extending away from the base. Target holders are attached to the arms and spaced along the length of the arms, and a target holder for non-planar targets is attached to the top of the base. The arms and base are collapsible to facilitate transport of the target rack.

8 Claims, 6 Drawing Sheets

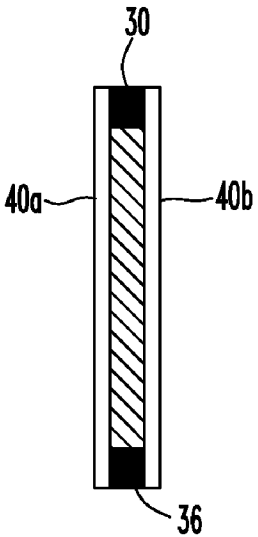
FIG. 5
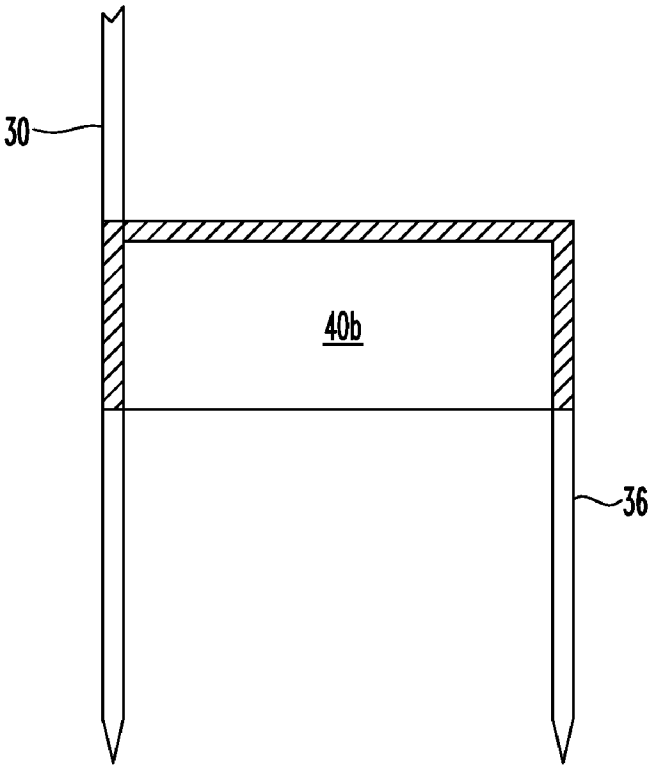
FIG. 4
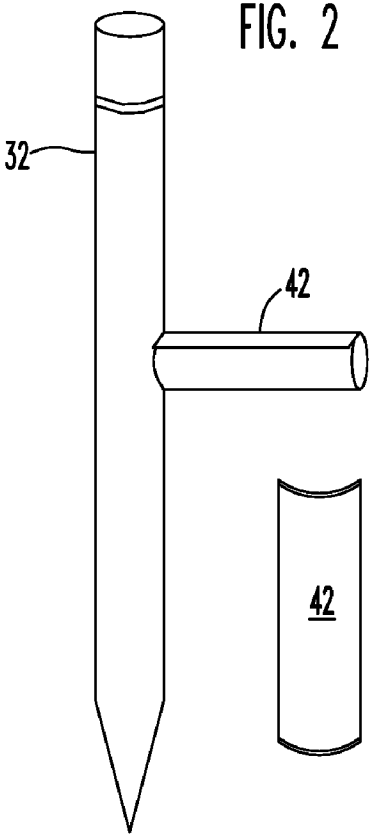
FIG. 2
FIG. 3

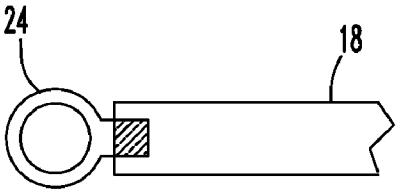
FIG. 17
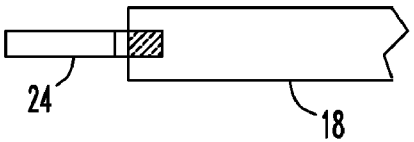
FIG. 18
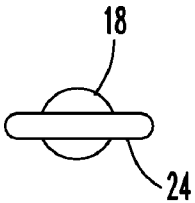
FIG. 19
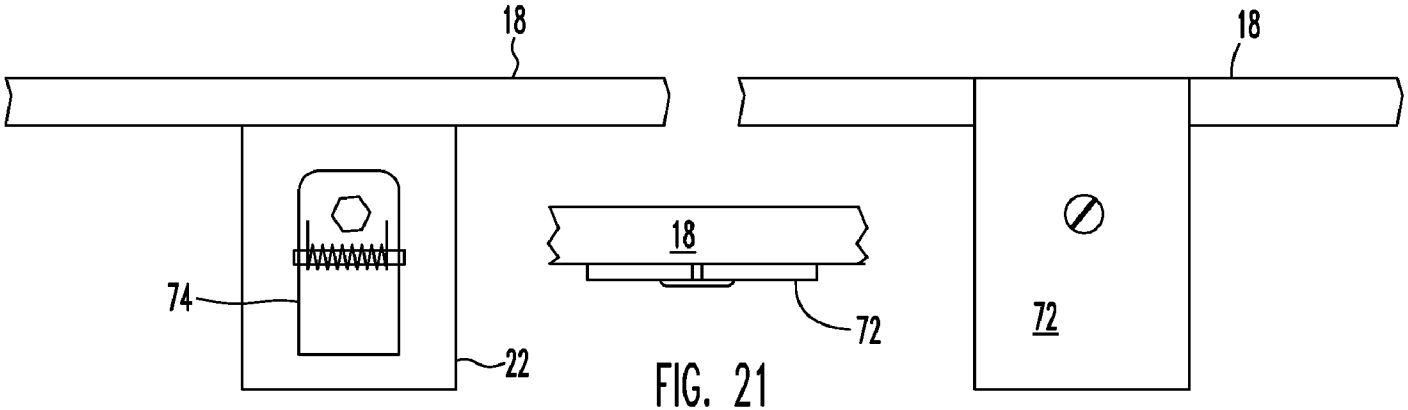
FIG. 20
FIG. 21
FIG. 22
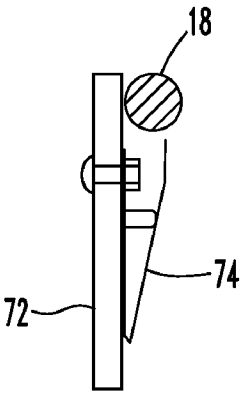
FIG. 23

PORTABLE TARGET RACK

This application claims the benefit of U.S. Provisional Application No. 60/659,726 filed Mar. 9, 2005.

FIELD OF THE INVENTION

The invention relates to recreational activities, namely, structures or supports that hold targets for shooting practice or target practice.

BACKGROUND OF THE INVENTION

Target shooters often prefer to practice outside far from residential or highly populated areas. Targets must be brought to the practice site and set up before target shooting can begin.

A portable target holder is known that can hold a single, planar target. Because the target holder holds only a single target, practice must be stopped each time it is necessary to replace the target. The types of targets that can be supported by the holder is also limited, thereby reducing the variety of different targets that can be used for practice.

Portable, foldable supports are also known that could be used to hold multiple targets. For example, Husted et al. U.S. Pat. No. 3,076,557 discloses a portable, foldable support that includes a pair of cross arms pivotally mounted to an elongate base by a connection assembly. Each cross arm could carry multiple target holders for holding the targets.

The connection assembly of the Husted et al. support is designed to resist vertical loads caused by the weight of items supported on the cross arms. The connection assembly, however, is not intended to resist horizontal loads or torques caused by a bullet or arrow impacting a cross arm or target holder. The cross arms can easily twist or raise up by these impact forces, making the support unsuitable for target practice.

Thus there is a need for an improved target holder. The improved target holder should simultaneously hold a number of targets, be portable and foldable for compact storage, and be capable of resisting the impact forces generated during a round of target practice.

SUMMARY OF THE INVENTION

The invention is an improved target holder. The improved target holder simultaneously holds a number of targets, is portable and foldable for compact storage, and resists the impact forces generated during a round of target practice.

A target holder or target rack in accordance with the present invention includes a base, a cross arm, and a connection assembly pivotally attaching the cross arm to the base for movement of the cross arm between extended and retracted positions. The cross arm has a holder portion for attaching target holders and attachment portion that extends at an angle from the holder portion. The connection assembly is attached to the upper end portion of the base and pivotally mounts the cross arm to the base, the cross arm movable between an extended position wherein the holder portion is substantially horizontal with respect to the vertical axis and a retracted position wherein the holder portion is substantially parallel with the vertical axis.

The connection assembly includes a pair of spaced apart plates and a pivot, the plates attached to the upper end portion of the base. The attachment portion of the cross arm is between the plates when the cross arm is in the extended position, the plates closely receiving the attachment portion to resist rotation of the cross arm about the holder portion and to resist movement of the cross arm towards each plate.

The plates resist translational movement of the cross arm urged by the forces generated by impacts to the target holders or cross arm. The offset attachment portion enables the plates to resist rotation of the cross arm by those same impact forces.

In a preferred embodiment a stop member that engages the cross arm when the cross arm is in the extend position extends beyond the plates. A collar receives the cross arm and the stop member to hold the cross arm in the extended position. The collar provides strong yet easily removable support of the cross arm.

Other objects, features, and advantages of the present invention will become apparent as the description proceeds, especially when taken in conjunction with the accompanying drawing sheets illustrating one embodiment of the invention.

BRIEF DESCRIPTION OF THE DRAWINGS

FIG. 2 is a front view of the lower rear leg member and attached foot pedal of the portable target rack;

FIG. 3 is a top view of the foot pedal alone;

FIG. 4 is a vertical sectional view taken through the front leg and prongs attached to the front leg of the portable target rack;

FIG. 5 is a section view taken along lines 5-5 of FIG. 4;

FIG. 16 is a sectional view taken generally along line 16-16 of FIG. 12;

FIGS. 17-19 are front, top, and end views of the free end of the one arm illustrating the eyebolt forming the additional support structure at the end of the arm;

FIG. 20 is a partial sectional view illustrating the rear of one of the target holders; and FIGS. 21-23 are similar to FIG. 20 but illustrating the top, front, and side of the target holder.

DESCRIPTION OF THE PREFERRED EMBODIMENT

Figure 1:
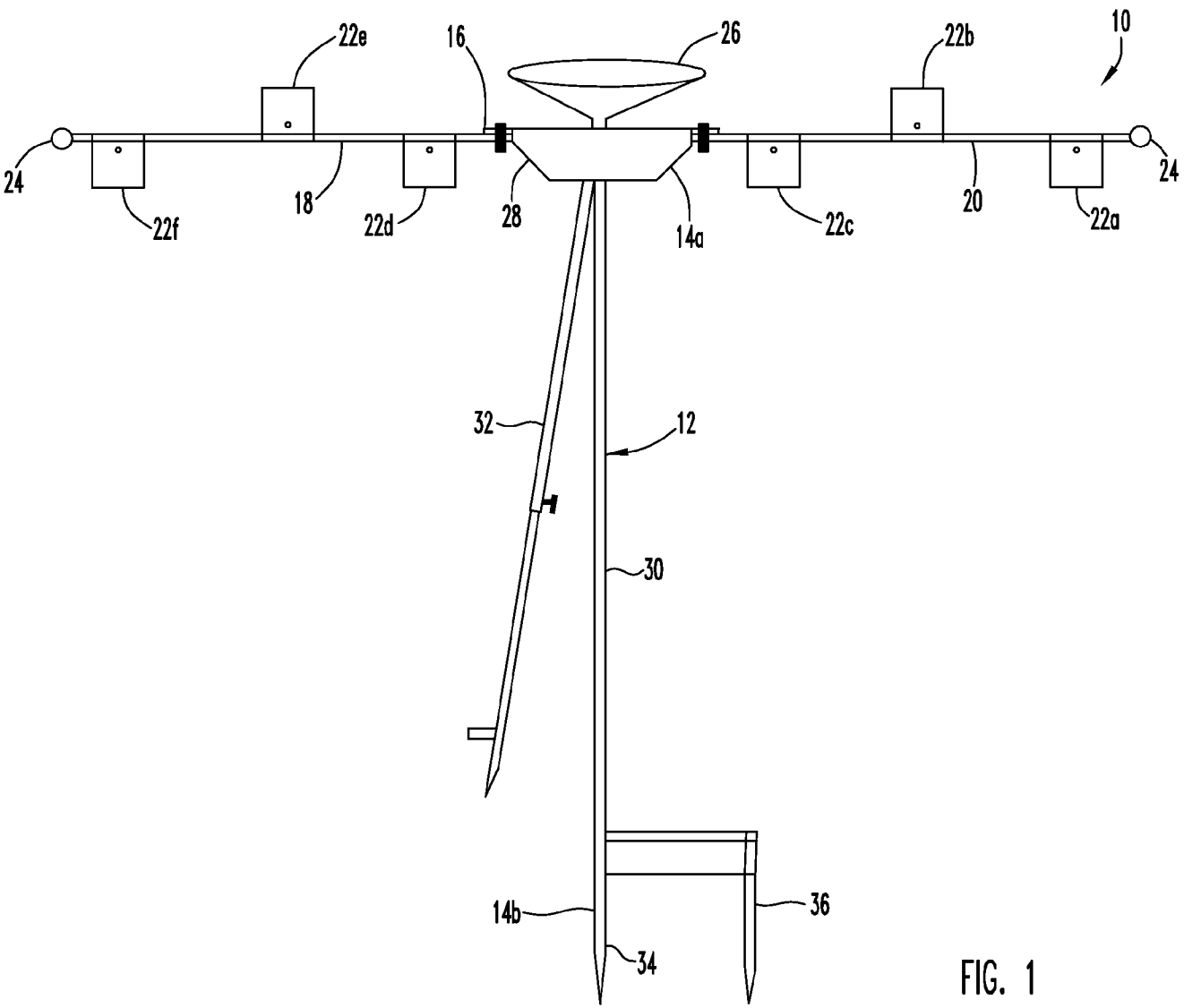
FIG. 1 is a front view of a portable target rack in accordance with the present invention.

FIG. 1 illustrates a portable target rack 10 in accordance with the present invention. Target rack 10 includes a base 12 having an upper end portion 14*a* and opposite end portion 14*b*. At the upper end of the base is a horizontal crossbar 16 that includes a pair of like elongate arms 18, 20 extending away from opposite sides of the base 12. Attached to horizontal portions of each arm 18, 20 are spaced apart target holders 22*a*-22*f*. Additional support structure 24 realized as an eyebolt is attached to the free end of each arm. An additional target holder 26 for non-planar targets is attached to the top of the base. Illustrated target holder 26 is a melon mount, but other types of target holders suitable for non-planar targets can be used.

Figure 9:
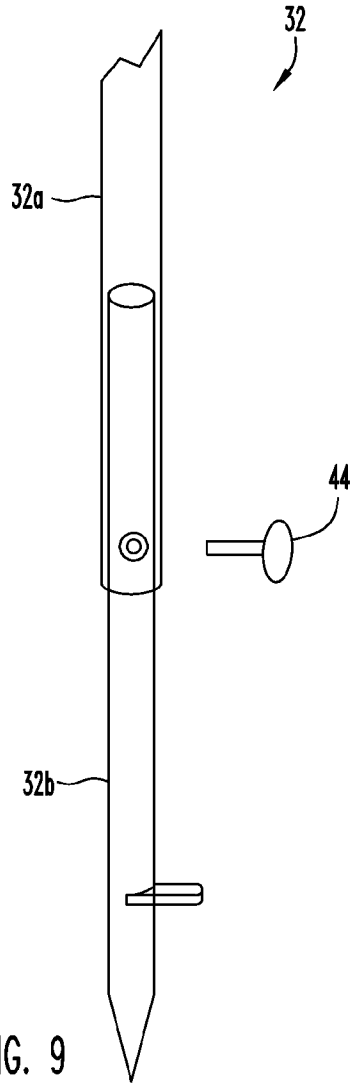
FIG. 9 is a view of the rear leg showing the adjustable-length assembly of the leg.

Base 12 includes a bracket assembly 28 located on the upper end portion of the base. Two legs 30, 32 extend downwardly from the bracket and end in feet 34, 36, and 38. Leg 30 is vertical in use and has a rectangular cross-section. Leg 32 is inclined to the vertical in use and is an adjustable-length assembly formed by telescoping leg members 32*a*, 32*b* (see FIG. 9).

The feet are spaced apart and define a triangle to support the weight of the rack and targets. The end of each foot 34, 36, 38 is formed as a pointed prong that can penetrate the ground for better support and additional resistance to over-turning. In the illustrated embodiment feet 34 and 38 are formed on the ends of legs 30 and 32. Foot 36 is attached to leg 30 and is sandwiched by flat plates 40*a*, 40*b* to provide a comfortable width for a user's foot to push feet 34, 36 into the ground. See FIGS. 4 and 5. A foot pedal 42 is attached to leg 32 for pushing foot 38 into the ground, see FIGS. 2 and 3.

Figure 6:
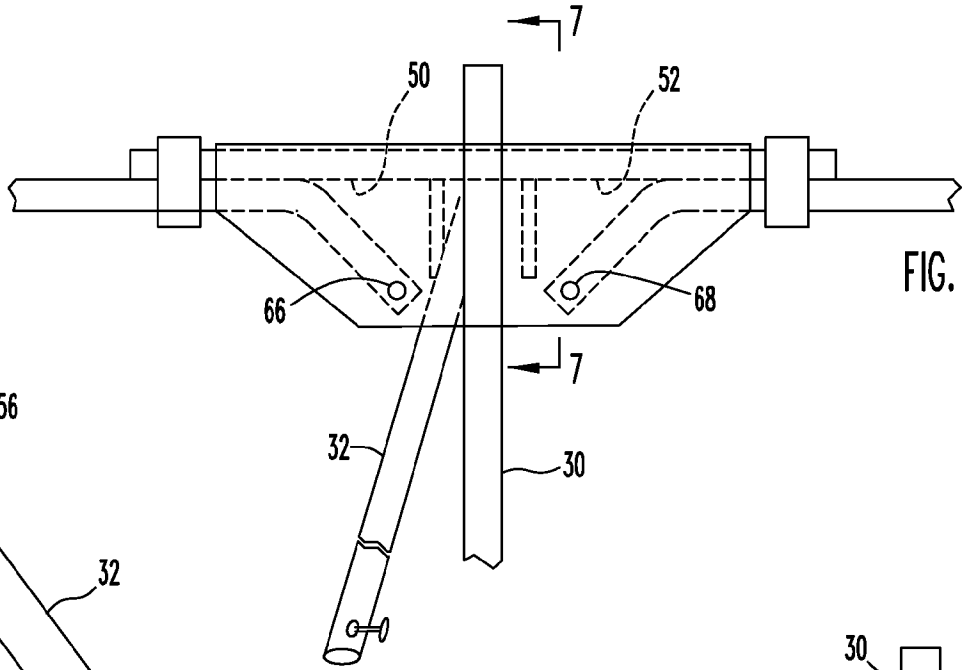
FIG. 6 is an enlarged view of the bracket assembly of the portable target rack.
Figure 8:
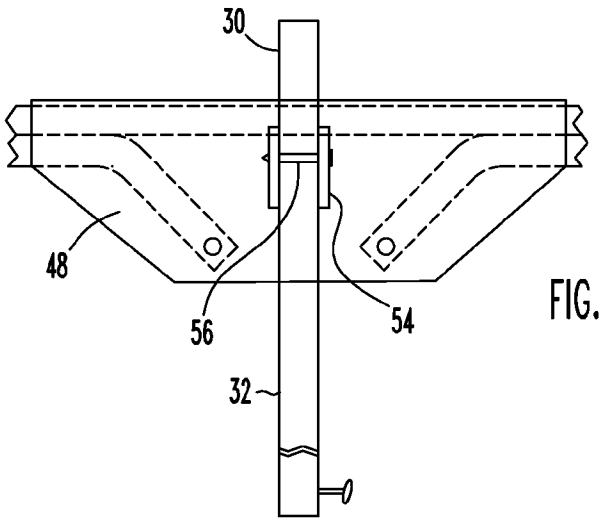
FIG. 8 is a rear view of the bracket assembly.
Figure 7:
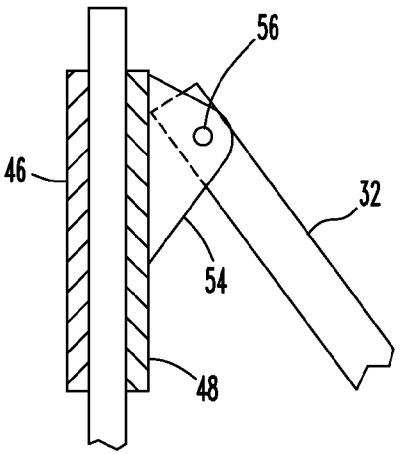
FIG. 7 is a sectional view of the bracket assembly taken along lines 7-7 of FIG. 6.

Bracket assembly 28 includes spaced-apart front and rear plates 46, 48 as shown in FIGS. 6-8. Leg 30 is sandwiched between and rigidly attached to the bracket plates, and extends upwardly beyond the plates as shown in FIG. 6. Crossbar members 50, 52 of crossbar 16 are also sandwiched between plates 46, 48 and extend along the upper edges of the plates. Members 50, 52 extend from opposite sides of leg 30 and extend outwardly beyond the plates. A clevis 54 attached to the rear of plate 48 pivotally mounts the upper end of leg 32 to the bracket assembly at pivot pin 56. Leg 32 is opposite leg 30 so that leg 32 rotates in the same plane as defined by leg 30.

Figure 10:
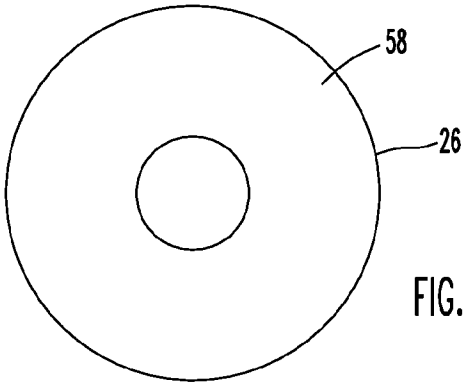
FIG. 10 is a top view of the melon mount attached to the base.
Figure 11:
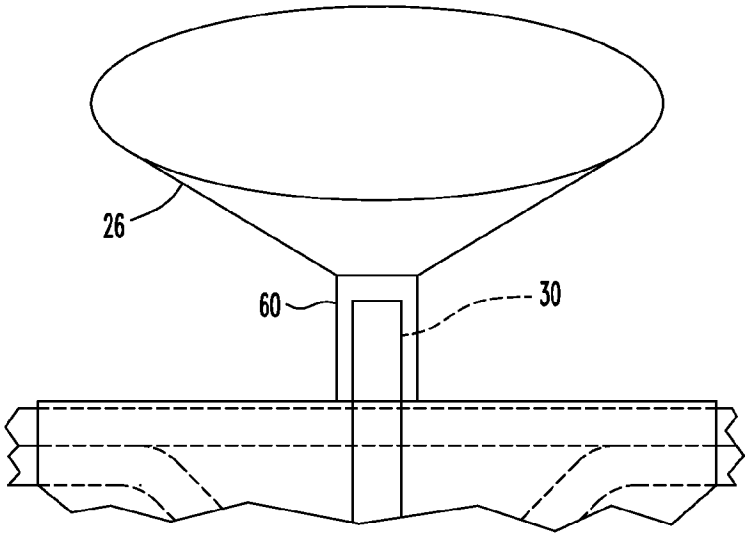
FIG. 11 is a front view illustrating attachment of the melon mount to the base.

Melon mount 26 is attached to the upper extension of leg 32. See FIGS. 10 and 11. Melon mount 26 has a conical platform 58 and a rectangular channel 60 that removably fits over the upper end of leg 32, forming a non-rotatable connection between the holder 26 and base 12.

Figure 12:
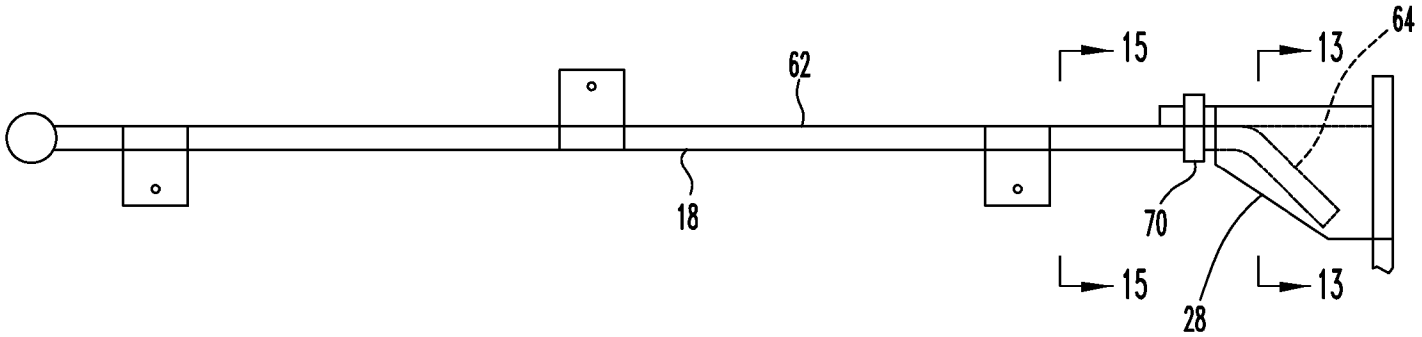
FIG. 12 is an enlarged, partial sectional view of one arm of the portable target rack, the target mounts attached to the arm, and the attachment of the arm to the bracket assembly.
Figure 14:
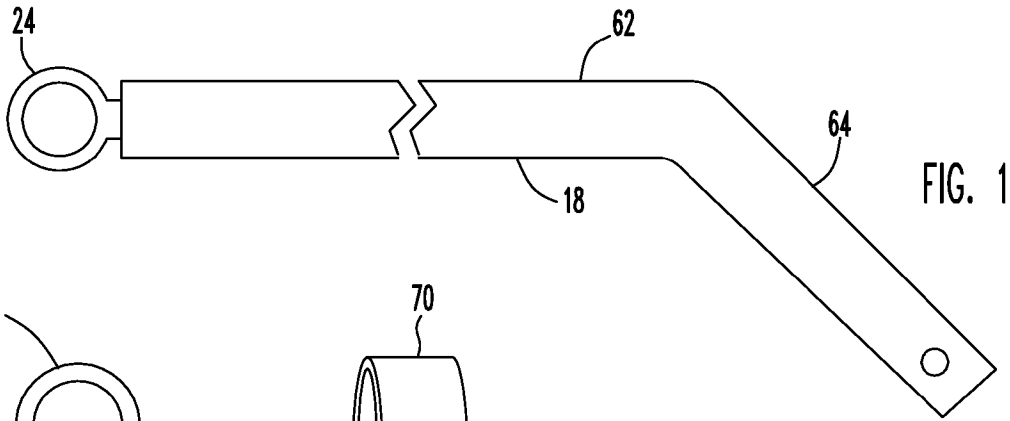
FIG. 14 is a view of one arm alone.
Figure 16:
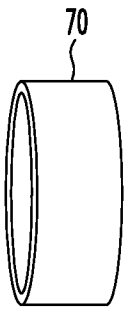
FIGS. 15 and 16 are side and front views of a coupling rigidly attaching an arm to the crossbar of the bracket assembly.
Figure 15:
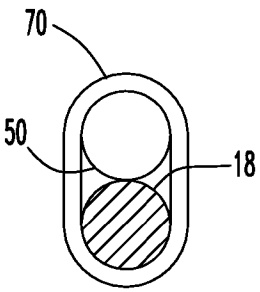
Figure 13:
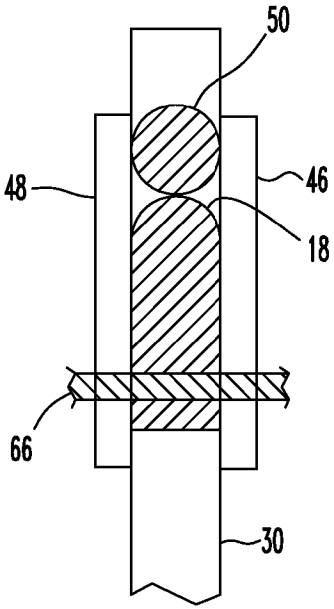
FIG. 13 is a sectional view taken generally along line 13-13 of FIG. 12.

Each arm 18, 20 is pivotally attached to the bracket assembly as shown in FIGS. 12 and 13 illustrating attachment of arm 18. Each arm includes a straight target holder portion 62 and a bent attachment portion 64 (see FIG. 14). Each attachment portion 64 is between bracket plates 46, 48 and beneath respective cross bars 50, 52. Arm 18 is pinned to the bracket assembly by pivot pin 66 and arm 20 is pinned to the bracket assembly by pivot pin 68 (shown in FIG. 6). The cross bars 50, 52 resist upward movement of the arms 18, 20 beyond the horizontal. The ends of the cross bars extend beyond the bracket plates to enable a coupler 70 carried on each arm to fit over the exposed end of the adjacent cross bar and hold the arm in the horizontal position.

Target holders 22 are attached to the back sides of arms 18, and are spaced apart along the length of each arm. Target holders 22*a*, 22*c*, 22*d*, and 22*f* extend below the arms to hold a target below the arm, and holders 22*b* and 22*c* extend above the arms to hold a target above the arm. Each holder 22 includes a flat mounting plate 72 that faces the target shooter and a spring clip 74 mounted on the opposite side of the plate. Spring clip 74 is intended to hold generally planar paper targets against plate 72. Other types of target holders are known and can be adapted for use with the present invention.

In use, feet 34 and 36 are inserted into the ground, and rear leg 32 is pivoted away from front leg 30. Leg 32 is adjustable in length to compensate for uneven terrain; foot 38 is inserted into the ground and set screw 44 is tightened to fix the length of foot 38 and rigidify the base.

Arms 18, 20 are opened and held open by couplers 70. In this operating condition the rack is at its maximum width defined by the ends of the crossarm 16. Targets are attached to each of the target holders 22 and a non-planar target can be placed on melon stand 26. Larger targets can span across and be held by multiple target holders 22.

Preferably targets are symmetrically arranged or loaded along crossbar 16 to minimize torque or moment acting on stand 12. The weight of a target held in melon mount 26 is directed down leg 30 to retain good stability of the stand.

If stand 10 is used in windy conditions, guy line or cord can be attached to eyebolts 24 and staked for extra support. If extra support is not needed, eyebolts 24 can be used to mount additional targets.

During target practice, a target holder 22 or a cross arm 18, 20 may be struck instead of a target. The impact attempts to push the cross arm 18 or 20 away from the base 12 and may attempt to rotate the cross arm about its longitudinal axis. The plates 46, 48 resist translational movement of the cross arm away from the base. The offset attachment portion 64 of the cross arm cooperates with the plates to resist rotation of the cross arm.

After use, the targets are removed and couplings 70 are slipped off cross bars 50, 52. The arms 18, 20 and rear leg 32 are pivoted downwardly to collapse the rack for transport. Arms 18, 20 can move to be substantially parallel with leg 30 to define a minimum-width configuration of the crossarm 16 for transport. Leg 32 can move to be substantially parallel with leg 30 to define a minimum-width configuration of the base 12 for transport. Leg 32 can also be shortened or if desired to reduce the overall length of the collapsed assembly.

For each cross arm 18 or 20, the holder portion 62 is spaced from its pivot pin 66 or 68 by the attachment portion 64 extending at an angle from the holder portion. This enables the holder portion to be spaced from the base 12 when the cross arm is in its retracted position. This spacing and the spacing of the pivot pin from the base provides sufficient spacing to fit the target holders 22 between the cross arm and the base when the cross arm is in the retracted position and the holder portion is parallel with the base.

Illustrated target rack 10 has overall dimensions of 38 inches in height and 14 inches in width in its open, in-use configuration, and 1¾ inches in depth in its closed, collapsed configuration. The component parts are preferably constructed from sturdy, rust-resistant metal alloys.

While I have illustrated and described a preferred embodiment of my invention, it is understood that this is capable of modification, and I therefore do not wish to be limited to the precise details set forth, but desire to avail myself of such changes and alterations as fall within the purview of the following claims.

The invention claimed is:

1. A target rack comprising:

a base having spaced upper and lower end portions defining a vertical axis;

a cross arm having opposite ends, the cross arm comprising a attachment portion at one end and a holder portion at the other end, the attachment portion not parallel with the holder portion and extending at an angle from the holder portion;

target holders attached to the holder portion of the cross arm;

a connection assembly attached to the upper end portion of the base and pivotally mounting the cross arm to the base, the cross arm movable between an extended position wherein the holder portion is substantially horizontal with respect to the vertical axis and a retracted position wherein the holder portion is substantially parallel with the vertical axis; and the connection assembly comprising a pair of spaced apart plates and a pivot, the plates attached to the upper end portion of the base, the attachment portion of the cross arm between the plates when the cross arm is in the extended position, the plates closely receiving the attachment portion to resist rotation of the cross arm about the holder portion and to resist movement of the cross arm towards each plate, the pivot extending between the plates and through the attachment portion of the cross arm for movement of the cross arm about the pivot, the holder portion of the cross arm spaced vertically upwardly from the pivot when the cross arm is in the extended position, whereby the holding portion of the cross arm is spaced away from the base when the cross arm is in the retracted position.

2. The target rack of claim 1 wherein the connection assembly comprises a stop member between the plates, the stop member engagable with the cross arm when the cross arm moves to the extended position.

3. The target rack of claim 1 wherein the stop member extends outwardly of the plates and the connection assembly comprises a separate coupler that receives the cross arm and the stop member to hold the cross arm in the extended position.

4. The target rack of claim 3 wherein the coupler is movable over a free end of the stop member to remove the coupler from the stop member.

5. The target rack of claim 1 comprising means for selectively supporting the cross arm in the extended position.

6. The target rack of claim 1 wherein the entire attachment portion of the cross arm is between the plates when the cross arm is in the extended position.

7. The target rack of claim 1 wherein the base represents a first leg of the target rack, the target rack comprising a second leg pivotally mounted to one of the plates.

8. The target rack of claim 1 wherein the attachment portion of the cross arm is an elongate member and the pivot extends through the attachment portion near the free end of the attachment portion.

* * * * *